US007210907B2

(12) United States Patent
Patti

(10) Patent No.: US 7,210,907 B2
(45) Date of Patent: May 1, 2007

(54) CENTRIFUGAL FAN IMPELLER WITH BLADES INCLINED RELATIVE TO THE AXIS OF ROTATION

(75) Inventor: Salvatore Patti, Bologna (IT)

(73) Assignee: Spal S.R.L, Correggio (Regio Emilia) (IT)

( * ) Notice: Subject to any disclaimer, the term of this patent is extended or adjusted under 35 U.S.C. 154(b) by 0 days.

(21) Appl. No.: 10/522,302

(22) PCT Filed: Jul. 30, 2003

(86) PCT No.: PCT/IB03/03207

§ 371 (c)(1),
(2), (4) Date: Jan. 25, 2005

(87) PCT Pub. No.: WO2004/015275

PCT Pub. Date: Feb. 19, 2004

(65) Prior Publication Data

US 2006/0051202 A1 Mar. 9, 2006

(30) Foreign Application Priority Data

Aug. 2, 2002 (IT) ..... BO2002A000519

(51) Int. Cl.
*F04D 29/30* (2006.01)

(52) U.S. Cl. ..... 416/178; 416/187; 416/203

(58) Field of Classification Search ..... 416/178, 416/187, 200 R, 203; 415/98, 119
See application file for complete search history.

(56) References Cited

U.S. PATENT DOCUMENTS

| | | | | |
|---|---|---|---|---|
| 1,478,909 A | | 12/1923 | Oswald | |
| 2,980,990 A | | 4/1961 | Sprouse | |
| 4,329,118 A | * | 5/1982 | Ranz | 416/178 |
| 4,526,506 A | | 7/1985 | Köger et al. | |
| 5,611,667 A | * | 3/1997 | Nagamori et al. | 416/178 |
| 6,158,954 A | * | 12/2000 | Nabeshima et al. | 415/119 |
| 6,883,411 B2 | * | 4/2005 | Arrasmith et al. | 416/187 |
| 2002/0021967 A1 | | 2/2002 | Kim et al. | |

FOREIGN PATENT DOCUMENTS

| | | |
|---|---|---|
| DE | 2322734 | 11/1974 |
| DE | 3708130 A1 | 9/1988 |
| DE | 0816687 A2 | 1/1998 |
| DE | 19736657 A1 | 5/1998 |

* cited by examiner

*Primary Examiner*—Igor Kershteyn
(74) *Attorney, Agent, or Firm*—The Nath Law Group; Jerald L. Meyer; Derek Richmond

(57) ABSTRACT

The invention relates to a centrifugal fan impeller (1) having an axis of rotation (6) and comprising one or more modules (2). Each module (2) comprises a mounting disc (4), at least one connecting ring (5) and a plurality of blades (3) extending between the mounting disc (4) and the connecting ring (5). The blades (3) are connected to the disc (4) and ring (5) at an angle ($\alpha$) relative to the axis (6) of the impeller (1). The angle ($\alpha$) at which the blades (3) are inclined may range from 5 to 30 degrees and the blades (3) may be rectangular or trapezoidal in shape depending on the type of performance required: improved capacity with rectangular blades or improved pressure head and acoustic properties with trapezoidal blades. Top performance is thus combined with acoustic comfort.

8 Claims, 6 Drawing Sheets

CENTRIFUGAL FAN IMPELLER WITH BLADES INCLINED RELATIVE TO THE AXIS OF ROTATION

TECHNICAL FIELD

The present invention relates to an impeller for a centrifugal fan whose blades are inclined relative to the axis of rotation of the impeller itself.

The impeller according to the invention can be used in fans for several different applications, for example, for moving air through a heat exchanger in a motor vehicle heating system. The invention can also be applied to fans for home air conditioning or heating installations.

BACKGROUND ART

Impellers for fans of this type must meet several requirements, including: low noise; good noise spectrum distribution; high efficiency; dimensional compactness; good pressure head and capacity.

Document EP-0 816 687 discloses a centrifugal fan having an impeller with inclined blades.

The blades are arranged on an annular surface around the impeller axis. Each blade has a tapering section and is curved outward, that is to say, has edge portions that are curved outward.

This constructional design, although it effectively reduces noise, is difficult to make by plastic injection moulding. Thus, document EP-0 816 687 also proposes a specific method for manufacturing the impeller and moulds especially designed for this purpose.

The present invention has for an aim to provide an improved, low-noise centrifugal fan impeller with inclined blades which offers top performance in terms of pressure head and capacity and which, at the same time, is easy to construct.

DISCLOSURE OF THE INVENTION

According to one aspect of it, the present invention provides a centrifugal fan impeller with inclined blades as defined in claim 1.

The dependent claims refer to preferred, advantageous embodiments of the invention.

BRIEF DESCRIPTION OF THE DRAWINGS

The accompanying drawings illustrate embodiments of the present invention without limiting the scope of its application, and in which.

DETAILED DESCRIPTION OF THE PREFERRED EMBODIMENTS OF THE INVENTION

Below are short definitions of the terms used to describe the impeller according to this invention:

the leading edge (A) is the line that delimits the front of the blade, that is to say, the first part of the blade profile to come into contact with the fluid flow;

the trailing edge (U) is the line that delimits the back of the blade, that is to say, the last part of the blade profile to come into contact with the fluid flow;

the chord (L) is the length of the line joining the ends of the arc extending from the leading edge to the trailing edge for an aerodynamic profile of the blade section at the intersection between the blade and a plane perpendicular to the axis of rotation of the impeller;

the centre line (MC) of the blade is the line joining the midpoints of the chords L at the different radiuses;

the inclination ($\alpha$) of the blade is the angle made by the centre line (MC) of the blade and the axis of the impeller;

the camber (f) is the longest perpendicular line to the chord (L), measured from the chord (L) to the profile or camber line of the blade; the position of the camber (f) relative to the chord (L) may be expressed as a percentage of the length of the chord itself.

Figure 1:
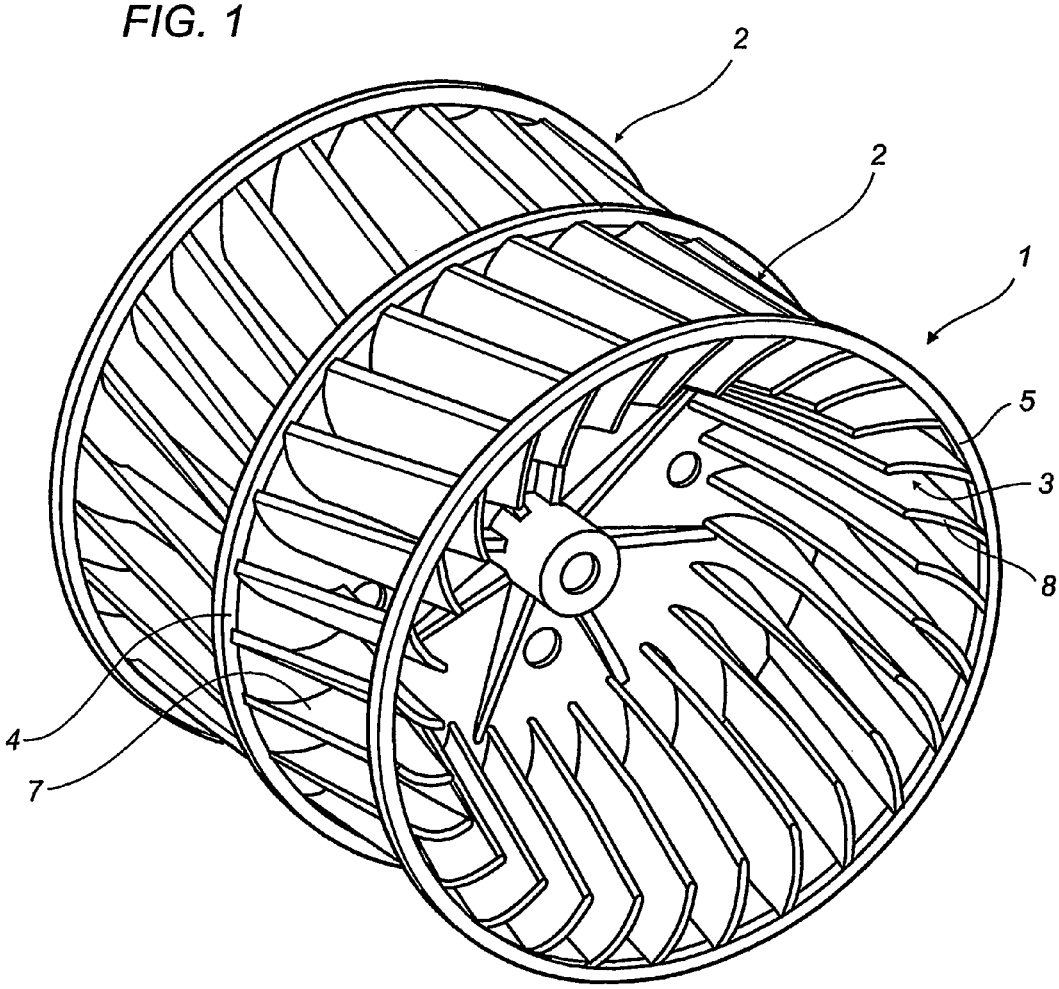
FIG. 1 is a perspective side view of the impeller according to the present invention.
Figure 2:
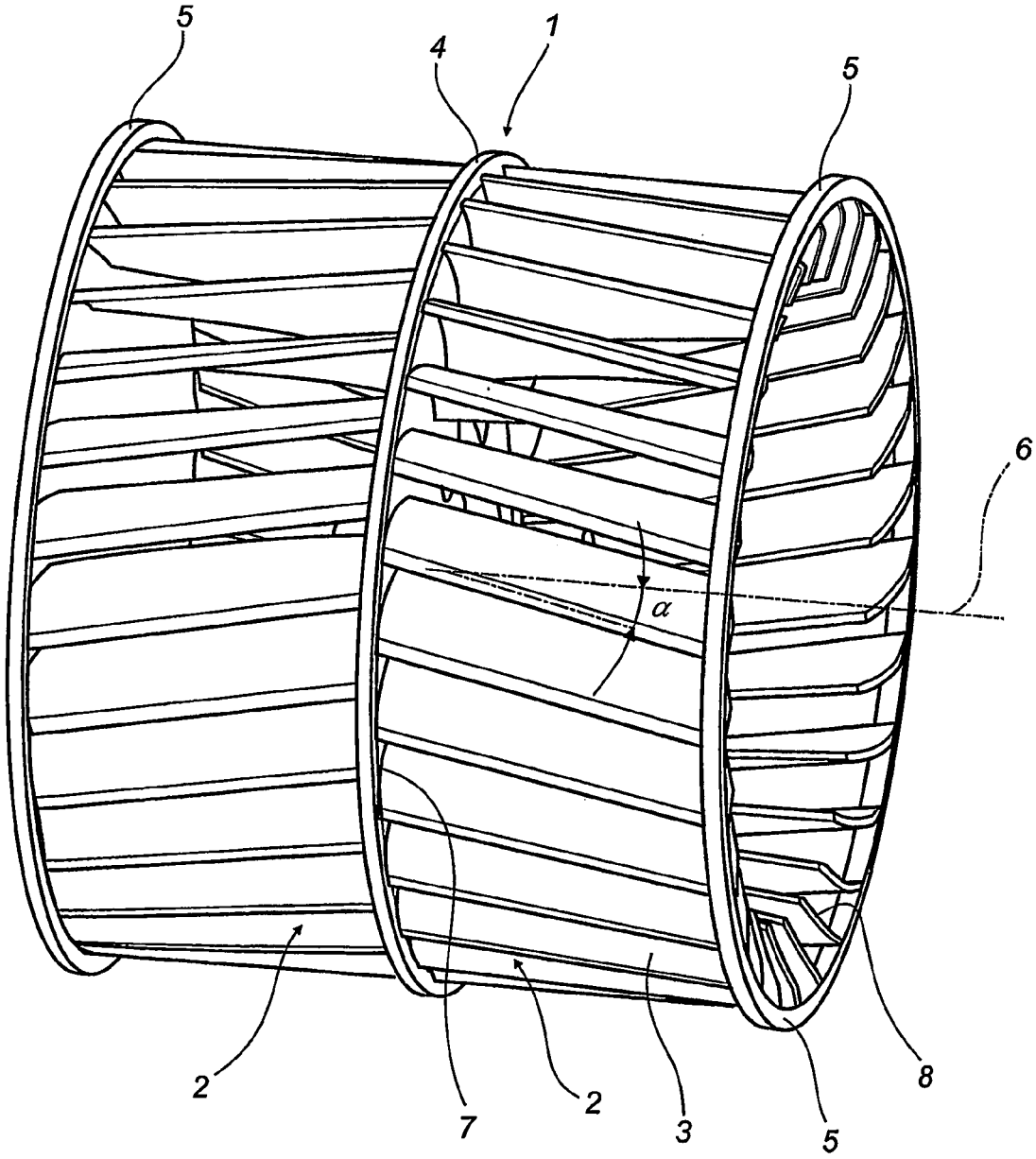
FIG. 2 is a perspective front view of the impeller of FIG. 1.

With reference to FIGS. 1 and 2 of the accompanying drawings, the numeral 1 denotes in its entirety the impeller according to the invention.

The impeller 1 may consist of two or more modules 2, each of which comprises a plurality of blades 3 extending between a mounting disc 4 and at least one connecting ring 5. The blades 3 are connected to these components at an angle a relative to the axis 6 of the impeller 1. The angle $\alpha$ may range from 5 to 30 (sexagesimal) degrees and is preferably 10 degrees.

The blades 3 of two adjacent modules 2 may be inclined in the same direction or in opposite directions. Further, the blades 3 of one module 2 are preferably offset with respect to those of the adjacent module 2, that is to say, the end of one blade 3 of one module 2 is approximately half way along the space between two blades 3 of the adjacent module 2.

In one preferred embodiment, the impeller 1 is designed to be mounted in a centrifugal fan which sucks fluid in from both sides.

In another embodiment which is not illustrated, air is sucked in from only one side of the fan, whilst the blade 3 mounting disc 4 is located on the opposite side to that were air is sucked in. In the latter case, the impeller 1 may comprise two or more modules 2 placed side by side.

Figure 3:
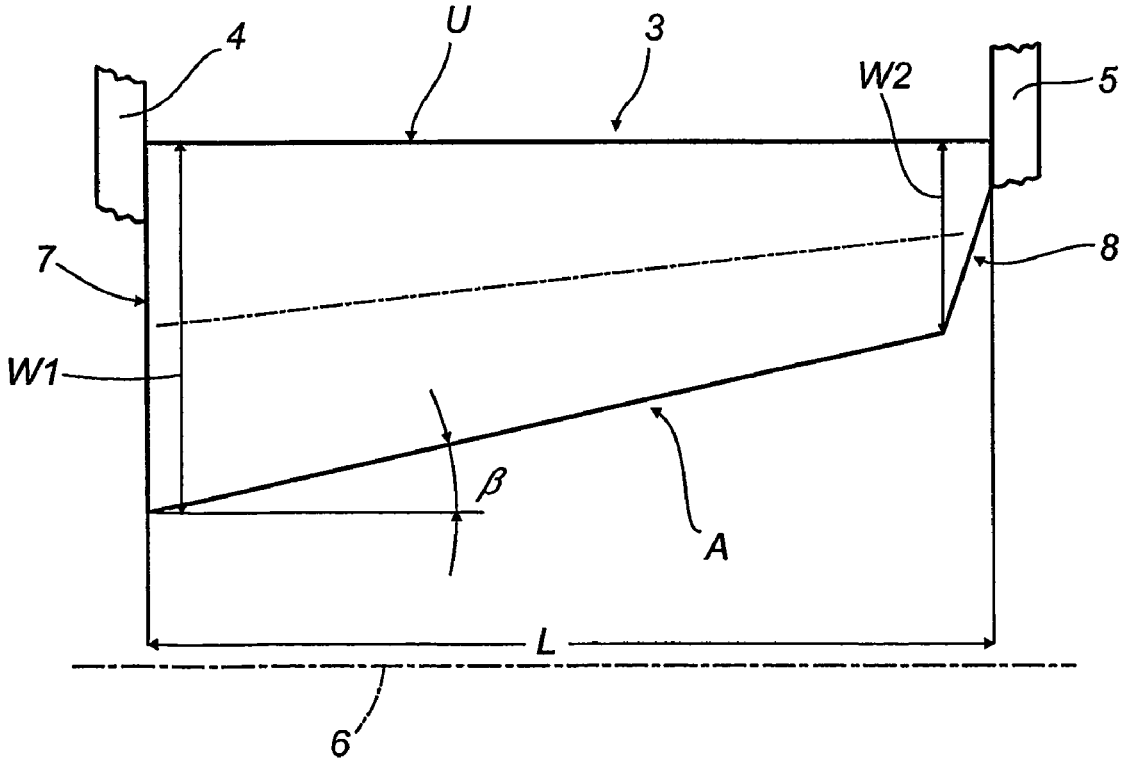
FIG. 3 is a side plan view of a blade forming part of the impeller of FIG. 1.
Figure 4:
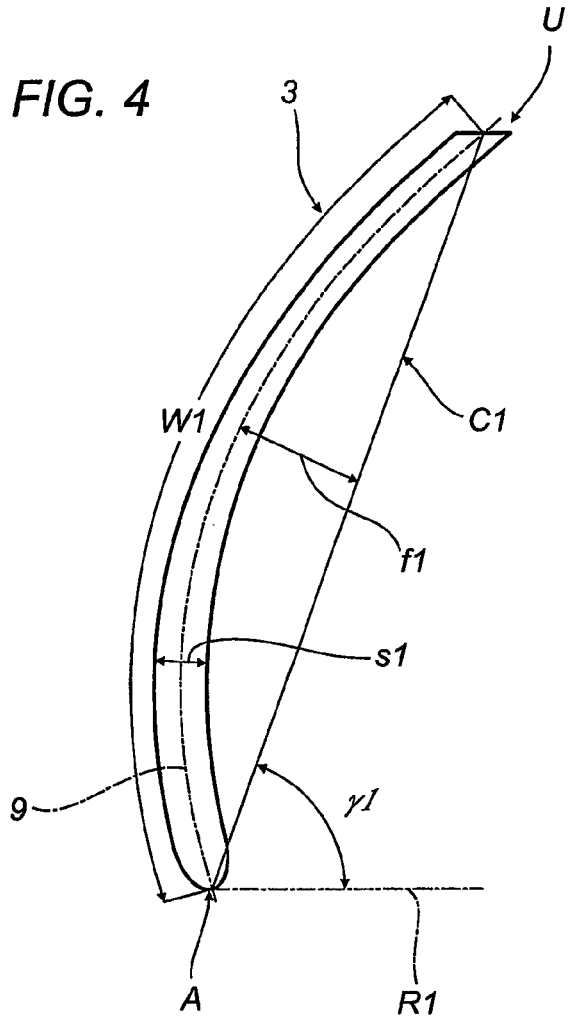
FIGS. 4 and 5 illustrate sections, respectively at the root and at the end of a blade forming part of the impeller of FIG. 1.
Figure 5:
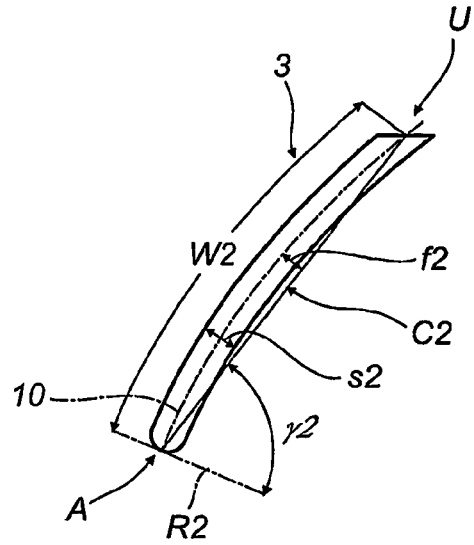

The geometrical characteristics of each blade 3 are illustrated in FIGS. 3 to 5.

FIG. 3 illustrates a blade 3 in a straightened plan view. The blade 3 is basically trapezoidal in shape but it might also be rectangular to enhance capacity compared to head.

The blade 3 comprises a straight leading edge A, inclined at an angle $\beta$ relative to the axis 6 of the impeller 1, a straight trailing edge U, parallel to the axis 6 of the impeller 1, a root 7 attached to the 4 and an end 8 connected to the ring 5.

The angle $\beta$ at which the leading edge 4 is inclined may range from 0 degrees, in the case of rectangular blades 3, to 40 (sexagesimal) degrees.

The rectangular or trapezoidal shape of the blades 3 depends on the type of performance required: rectangular blades provide improved capacity, while trapezoidal blades achieve greater head and better acoustic properties.

A preferred value for the angle β, which provides excellent performance in terms of capacity, pressure head and acoustic properties is 12.65 degrees.

The blade 3 extends for a length L, the profile of the blade 3 has a straightened length W1, measured along the centre line of the profile, at the root 7, and a straightened length W2 at the end 8.

The lengths W1, W2 of the profiles expressed as ratios of the length L are the following:

W2 between 0.3 and 0.5 of the length L, preferably 0.35;

W1 between 0.3 and 0.8 of the length L, preferably 0.70.

FIGS. 4 and 5 illustrate sections of the blade 3 profile at the root 7 and at the end 8, respectively.

The curvature of the centre line 9 of the profile at the root 7 is defined by the equation $$Y = Y_0 + \bar{a}_1(x - x_0) + \bar{b}_1(x - x_0)^2 + \bar{c}_1(x - x_0)^3 + \bar{d}_1(x - x_0)^4$$

where $$\bar{a}_1 = -\frac{1}{95.6};\quad \bar{b}_1 = \frac{1}{27.9};\quad \bar{c}_1 = -\frac{1}{61500};\quad \bar{d}_1 = \frac{1}{32300}.$$

The profile has a chord C1 of 21.488 mm, a constant thickness S1 of 1.1 mm and a camber f1 of 4.20306 mm between the centre line 9 and the chord C1.

The curvature of the centre line 10 of the profile at the end 8 is also defined by the equation $$Y = Y_0\bar{a}_1(x-x_0) + \bar{b}_1(x-x_0)^2 + \bar{c}_1(x-x_0)^3 + \bar{d}_1(x-x_0)^4$$

where the constants are the same as those stated above.

The profile has a chord C2 of 14.154 mm, a constant thickness S2 of 1.1 mm and a camber f2 of 1.5033 mm.

The cambers f1 and f2 are approximately half way along the respective chords C1 and C2, these positions being specified by the values lf1, lf2 in the table below.

The values of thickness S1, S2 and of camber f1, f2 of the profiles expressed in relation to the chords C1 and C2 are the following:

S1 between 5% and 8% of the chord length C1, preferably 6%;

f1 between 10% and 15% of the chord length C1, preferably 12%;

S2 between 6% and 10% of the chord length C2, preferably 8%;

f2 between 10% and 15% of the chord length C2, preferably 12%.

The chord C1 of the profile at the root 7 makes an angle γ1 with the radius R1 measured at the leading edge A. The angle γ1 may range from 50 to 80 (sexagesimal) degrees and is preferably 65.2 degrees.

The chord C2 of the profile at the end 8 makes an angle γ2 with the radius R2 measured at the leading edge A. The angle γ2 may range from 33 to 63 (sexagesimal) degrees and is preferably 48.2 degrees.

The description below refers to a preferred embodiment of an impeller according to the present invention without restricting the scope of the inventive concept. The impeller 1 illustrated in the accompanying drawings is made up of two symmetrical modules 2 with lateral suction.

Each module 2 has twenty-eight blades, which are offset with respect to those of the adjacent module 2, has an outside diameter of approximately 99 mm and is approximately 44 mm wide.

Figure 8:
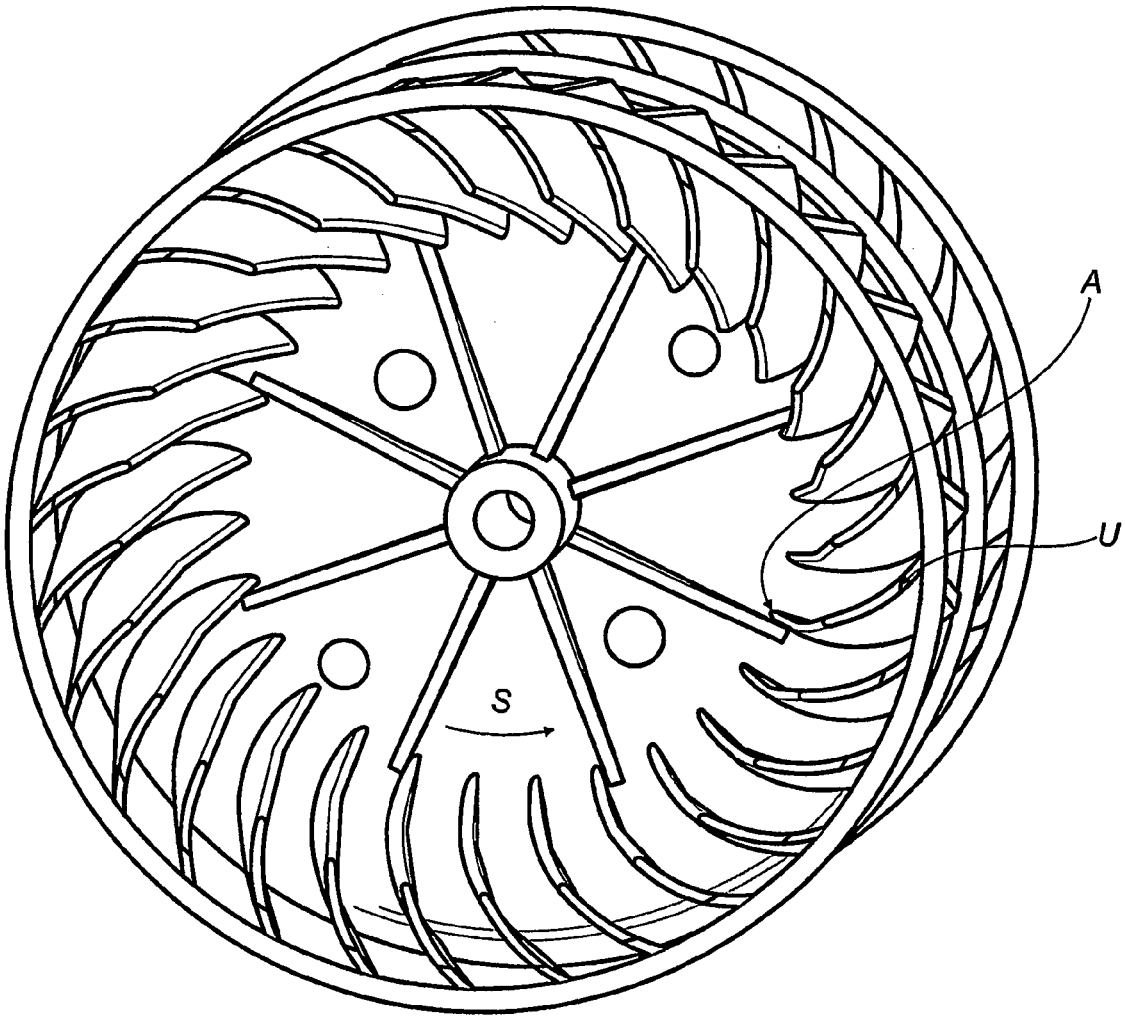
FIG. 8 is a front view of the impeller of FIG. 1.

The impeller 1 according to the present invention rotates preferably in the direction indicated by the arrow S in FIG. 8, that is to say, in the direction such that, when the impeller turns in that direction, the leading edge A of the blades 3—on the innermost diameter—is behind the trailing edge U—on the outermost diameter.

This configuration gives the best results in terms of silent operation and performance of the impeller 1.

All the characteristic values of the proposed preferred embodiment of the fan blade 3 according to the invention are summarised in the table below, where C1, C2 indicates the chord length;

f1, f2 indicates the camber;

lf1, lf2 indicates the camber position relative to the chord C1, C2;

S1, S2 indicates the profile thickness;

W1, W2 indicates the straightened length of the profile;

α indicates the angle made by the centre line MC of the blade and the axis 6 of the impeller;

β indicates the angle made by the leading edge of the blade 3 and the axis 6 of the impeller;

γ1, γ2 indicate the angle made by the profile of the blade 3, at the root and end of the blade respectively, with respect to an impeller radius R1, R2 passing through the leading edge of the profile.

| Position/value | Root | End |
|---|---|---|
| C1/C2 | 21.488 mm. | 14.154 mm. |
| F1/f2 | 4.203 mm. | 1.503 mm. |
| Lf1/lf2 | 53.92% | 41.44% |
| S1/S2 | 1.1 mm. | 1.1 mm. |
| α | 10° | 10° |
| β | 12.65° | 12.65° |
| γ1, γ2 | 65.2° | 48.2° |

Figure 6:
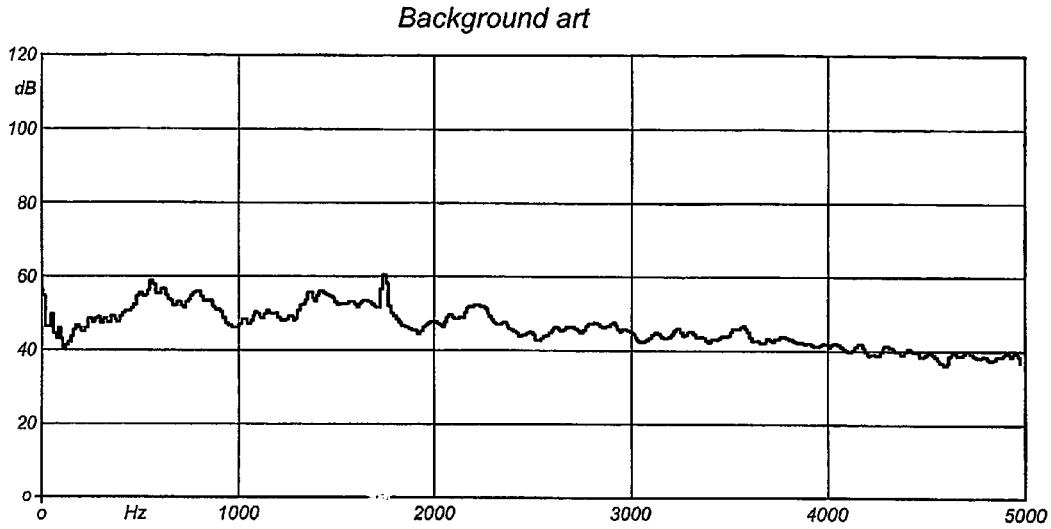
FIG. 6 is a sound spectrum diagram of a prior art impeller.
Figure 7:
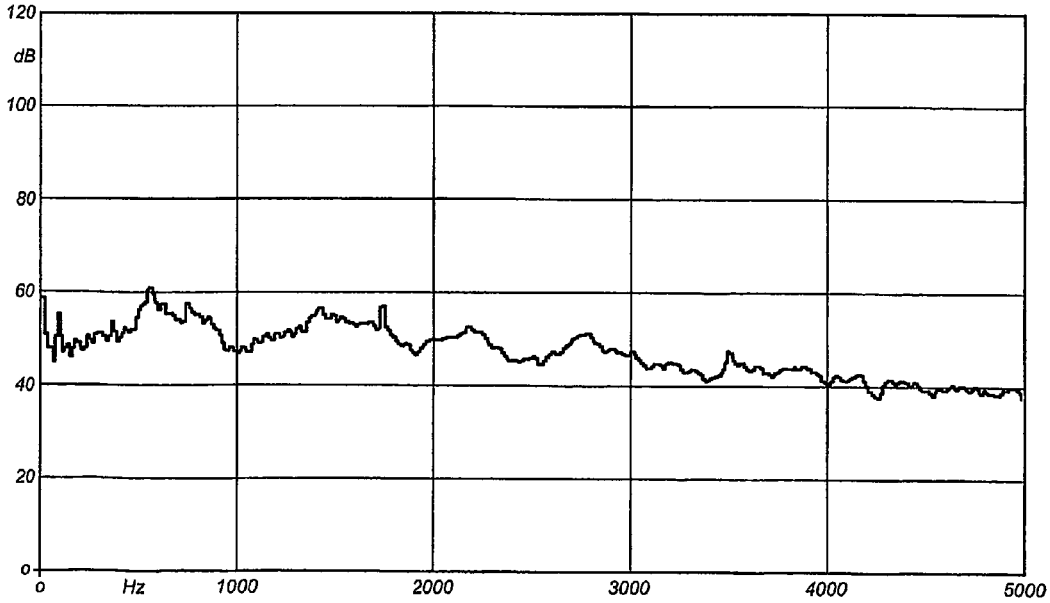
FIG. 7 is a sound spectrum diagram of the impeller of FIG. 1.

FIGS. 6 and 7 illustrate the results of tests in which a conventional straight-blade impeller (FIG. 6) was compared with an impeller made according to the present invention (FIG. 7), both impellers having the same capacity and pressure head.

The tests showed a reduction in sound level of around 1 dB(A) and a significant improvement in terms of acoustic comfort.

In this connection, it should be remembered that the sensitivity of the human ear is a function of two main variables: frequency and sound pressure level.

The sensitivity of the human ear decreases at low frequencies, increases at medium frequencies and decreases again at high frequencies. It is therefore possible to create graphs of the perceived intensity (loudness) of sound, commonly known as "equal loudness curves", used, for example, by national and international standard organisations.

The impeller according to the present invention makes it possible to shift the sound pressure level towards frequencies that are less disturbing to the human ear, which, in other terms, means that the sound made by the impeller is more "pleasant".

The invention described can be subject to modifications and variations without thereby departing from the scope of the inventive concept, as defined in the claims herein.

Moreover, all the details of the invention may be substituted by technically equivalent elements.

The invention claimed is:

1. A centrifugal fan impeller (1) having an axis of rotation (6) and comprising one or more modules (2), comprising a mounting disc (4), at least one connecting ring (5) and a plurality of blades (3) extending between the mounting disc (4) and the connecting ring (5), the blades (3) being connected to the disc (4) and ring (5) at an angle ($\alpha$) relative to the axis (6) of the impeller (1), the impeller being characterised in that the angle ($\alpha$) at which the blades (3) are inclined is 10 degrees, in that the connecting ring (5) is positioned on an outer diameter in respect to the blades (3), whereby the inner part of the mould for producing the fan impeller (1) can be extracted axially from both sides of the fan impeller (1), in that the profile of each blade (3) at a root thereof is inclined at an angle ($\gamma$l) ranging from 50 to 80 degrees, and in that the profile of each blade (3) at an end thereof is inclined at an angle ($\gamma$2) ranging from 33 to 63 degrees, said angles ($\gamma$1, $\gamma$2) at the root (7) and at the end (8) of the blade (3) being defined as the angles made by the profile of the blade (3), at the root and end of the blade respectively, with respect to an impeller radius (R1, R2) passing through the leading edge (A) of the profile.

2. The impeller according to claim 1, characerised in that each blade (3) is substantially trapezoidal in shape when seen in a straightened plan view.

3. The impeller according to claim 2, characterised in that each blade (3) has a straight leading edge (A) inclined at an angle ($\beta$) ranging from 0 to 40 degrees with respect to the axis (6) of the impeller (1).

4. The impeller according to claim 2, characterised in that each blade (3) has a straight trailing edge (U) parallel to the axis (6) of the impeller (1).

5. The impeller according to claim 2, characterised in that each blade (3) has a straight leading edge (A) inclined at an angle ($\beta$) of 12.65 degrees with respect to the axis (6) of the impeller (1).

6. The impeller according to claim 1, characterised in that each blade (3) is substantially rectangular in shape when seen in a straightened plan view.

7. The impeller according to claim 1, characterised in that the profile of each blade (3) at the root is inclined at an angle ($\gamma$1) of 65.2 degrees.

8. The impeller according to claim 1, characterised in that the profile of each blade (3) at the end is inclined at an angle ($\gamma$2) of 48.2 degrees.

* * * * *

UNITED STATES PATENT AND TRADEMARK OFFICE

CERTIFICATE OF CORRECTION

PATENT NO. : 7,210,907 B2
APPLICATION NO. : 10/522302
DATED : May 1, 2007
INVENTOR(S) : Patti It is certified that error appears in the above-identified patent and that said Letters Patent is hereby corrected as shown below:

Title page, delete:

"(73) Assignee: Spal S.R.L.
Correggio (Regio Emilia)
(IT)"

And replace with:

-- (73) Assignee: SPAL AUTOMOTIVE S.R.L.
Correggio (Regio Emilia)
(IT) --

Signed and Sealed this

Twenty-second Day of June, 2010

David J. Kappos

David J. Kappos
*Director of the United States Patent and Trademark Office*